US005088728A

United States Patent [19]

Deden

[11] Patent Number: 5,088,728

[45] Date of Patent: Feb. 18, 1992

[54] EXERCISE HARNESS

[76] Inventor: Mike J. Deden, 1530 Maurice Ave., Missoula, Mont. 59801

[21] Appl. No.: 510,050

[22] Filed: Apr. 17, 1990

[51] Int. Cl.[5] ..... A63B 21/00

[52] U.S. Cl. ..... 272/143; 272/119; 224/215

[58] Field of Search ..... 272/93, 109, 116, 117, 272/118, 119, 123, 134, 143; 224/151, 153, 154, 209, 211, 215

[56] References Cited

U.S. PATENT DOCUMENTS

| | | | |
|---|---|---|---|
| 2,986,314 | 5/1961 | Miller . | |
| 3,322,425 | 5/1967 | Moore . | |
| 3,679,107 | 7/1972 | Perrine . | |
| 3,957,184 | 5/1976 | Shurman | 224/211 |
| 4,273,327 | 6/1981 | Nall et al. . | |
| 4,332,379 | 6/1982 | Bannister | 272/119 |
| 4,371,162 | 2/1983 | Hartzell | 272/134 |
| 4,589,658 | 5/1986 | Gibson | 272/134 |
| 4,653,750 | 3/1987 | McIntyre | 272/143 X |
| 4,674,160 | 6/1987 | Gibson | 272/134 |
| 4,674,664 | 6/1987 | Simon | 224/215 |
| 4,714,247 | 12/1987 | Gerstung | 272/119 X |
| 4,944,509 | 7/1990 | Snider | 272/119 |

FOREIGN PATENT DOCUMENTS 2211551 9/1973 Fed. Rep. of Germany ..... 272/119

*Primary Examiner*—Robert Bahr

[57] ABSTRACT

The thoracic harness disclosed is for particular use in facilitating the performance of squat related exercise by providing superior three dimensional thoracic engagement of resistance forces connectable at opposing points below the axillae or armpits. The thoracic harness functions to uniformly disperse resistance forces three dimensionally about respectively engaged thoracic surfaces to oppose thoracic movements occurring in the user's three dimensional space. The harness includes opposed flexible shoulder scyes joined by a back panel and a releasable frontal strap that are anatomically designed to collectively function to provide maximum three dimensional surface engagement and to enable maximum unrestricted movement of respective thoracic "active" regions. In addition, the harness provides a totally self-maintaining engagement nature that eliminates concern of potential injury and allows maximum exercise concentration. Furthermore, the thoracic harness configuration described can be comfortably used by either male or female by largely avoiding sensitive breast tissues.

6 Claims, 4 Drawing Sheets

EXERCISE HARNESS

TECHNICAL FIELD

The present invention relates to a thorax mountable harness that provides a self-maintaining intimate, three dimensional, thoracic engagement adapted for attachment to selected resistance at lateral points below the axillae, to facilitate performance of exercise in the user's fronal, sagittal and transverse planes, or combination thereof.

BACKGROUND OF THE INVENTION

The "squat" is considered to be the most productive strengthening movement of the entire body, and involves the body's largest and most powerful musculoskeletal systems. These systems include the lower back, the buttocks and hips, the large muscles of the thigh and knee the lower leg and ankle, and others. As a compound exercise, the squat utilizes several joints and muscle groups in unison and provides a wide variety of training applications to countless fundamental sports movements.

Being a "core" body movement, the squat has become the mainstay of "integrated athletic motion training" where gross motor skills and respective forces of athletic movements experienced during athletic participation are replicated against an opposing resistance. Essentially, integrated athletic motion training involves athletic movements such as jumping running, throwing, and so forth, closely replicated against an appropriate opposing resistance. Benefits of this training method includes gross motor skill acquistion, efficient strength transition to sport specific movements, a high level of fluid dynamic athletic strenght, and explosive homogenous power. Furthermore, proprioception components that sense body portion, movement, velocity, direction, timing and force production are developed, making a mind-body link that allows maximum athletic expression possible.

The integration of benefits from squatting, into athletic performances has yielded many problems due to the inability of squat related exercise devices to properly replicate (either passively or active) complex athletic movements associated with squatting. These movements involve complex gross body movements of the upper torso, hips and legs acting not only within an athletes sagittal plane, as most squat related devices are limited to, but also within the frontal and transverse planes that complete an athlete's three dimensional space.

Barbell squats and other similar mass engageable devices constitute the industries mainstay of squat related exercise devices. Though these devices provide proven training methods, they also yield inherent problems and limitations. Such devices create an elevated user's center of gravity, thus producing improper anatomical positioning and articulation of the lower back, hips, knees, and ankles resulting in potential injury and improper strength conditioning. The squat and other compound exercises performed explosively producr a considerable acceleration and momentrum differentation between the user and the engaged mass. This causes an irregular, out of user synchronization resistance and potential resultant injury from excessive jarring. Such potential for injury and irregular resistance, greatly limits the speed and proper simulation of athletic movements. Barbell squats and other similar mass engageable devices confine lifts to a vertically oriented direction within the user's sagittal plane. This is due to the difficulty in balancing the engaged weight, dampening transverse plane imparted momentum, and the potential for injury. Thus, proper integrated athletic motion training of squat related movements other than vertically oriented ones, are virtually impossible with these devices. Furthermore, the potential energy of the lifted engaged mass causes considerable fear and injury associated with failed attempts and therefore slows the progress of concerned users. In addition, the means in which barbell squats and similar mass engageable devices engage the user's upper shoulder regions are awkward, restricting, uncomfortable and require relentless monitoring, thus ultimately robbing critical benefits.

Squat related machines such as the leg press, hack squat and many others, attempt to correct the problem associated with barbell squats and are indeed successful in alleviating the danger of some injuries. However, in eliminating the hazard, such apparatus also eliminate the opportunity for proper integrated athletic motion training by restricting the user to predetermined paths of sagittal plane resistance. Like the barbell squat, this ultimately produces a great sagittal plane strength, developed through an unnatural center of gravity that is out of balance with strength capabilities available in the remaining frontal and transverse planes. Such sternght imbalances may result in injury within the improperly overtrained sagittal plane or to weaker planes of strength employed during athletic participation.

U.S. Pat. Nos. 3,679,107 and 2,986,314 both disclose weight or mass carrying yokes that facilitate attachment of selected weights to the user's shoulder vicinities. While such apparatus serve to distribute application forces of the weight bar of barbell squats, they still suffer from similar problems and limitations when proper integrated athletic motion training is attempted.

Various apparatus have been developed to lower the point of resistance below the user's shoulders. For example, U.S. Pat. Nos. 4,674,160 and 4,589,658 disclose a power squat apparatus in which a harness is used about the waist, with a central front and rear strap extending down and between the user's legs, to connect to a source of resistance. This arrangement, though obviously uncomfortable, adequately removes the potential of back strain and similar squat related injuries. However, it limits the benefits of the exercise to musculoskeletal systems acting about the knee and ankle. Furthermore, the central strap arrangement limits exercise to those performed primarily in the sagittal plane, thus proper integrated athletic motion training is questionable.

U.S. Pat. No. 3,322,425 discloses a weight lifting exercise device that includes a rigid harness arrangment constructed of a rectangular frame suspended from the user's shoulders. Opposite ends of the frame include bars that mount selected weight plates. The rectangular frame is constructed to be sufficiently large to loosely encircle the user's upper abdomen. The rigid should straps extend upwardly and over the shoulder from the front and back bars of the rectangular frame. This loose fit, while adapting the device to be used b a large number of different sized individuals, becomes uncomfortable and potentially hazardous in use. Furthermore, the loosly fitting frame has an overall effect of placing the point of resistance engagement back at the superior regions of the user's shoulders, instead of spreading it out from the elevation of weight plate attachment. Thus, such a device suffers from inherent mass and engagement related problems and limitations associated with barbell squats.

A somewhat different approach is made in U.S. Pat. No. 4,371,162. This patent discloses and exercising device that makes use of a shoulder harness arrangement constructed of elastic bands providing resistance, extending from a foot board up and over the user's shoulders. An optional backstrap is provided which is selectively attachable between the elastic straps, to aid their retention on the user's shoulders. Although, this arrangement eliminates those mass related problems associated with barbell squats and similar mass engageable devices, it suffers from an extremely awkward and restricting resistance engagement and application means, that demands constant user monitoring similar to that of the barbell squat and ultimately limits proper integrated athletic motion training.

BRIEF DESCRIPTION OF THE INVENTION

With the foregoing in mind, it ia an object of the present invention to provide a device that facilitates proper integrated athletic motion training for squat related exercises, thus eliminating the problems and limitations of prior art. To accommodate this method of training, the present invention incorporate a two point resistance receiving harness that intimately and securely engages the user's upper torso or thorax in a three dimensional manner (instead of simply the superior shoulder regions alone).

The preferred thorax engaging harness of the present invention includes a strong lightweight structure adapted to fit comfortably across the user's upper back by means of back panel, and encircles each shoulder by means of shoulder scye loops, each of which are equipped with a lateral resistance engagement element mounted below the axilla and are further furnished with an adjustable connector that transversely spans the upper chest, whereby connecting opposing shoulder scye loops.

From an anatomical standpoint, the thorax demonstrates no appreciable configuration change through it's ranges of motion, and therefore provides a relatively large uniform three dimensional structure, that facilitates exceptional three dimensional harness engagement. Engaging the thorax provides the considerable force distributing surfaces of the upper back, shoulders and upper chest regions. This accommodates a comforable and intimate harness engagement environment even under extreme loads. Furthermore, the self maintaining engaging nature of the present invention permits the user to focus all of his or her concentration into a particular lift for maximum benefits and therefore eliminates the constant monitoring or engagement concern associated with prior art. Thus, the thorax engaging harness of the present invention is adapted to apply a squat related integration of sagittal, frontal and transverse plane resistance (i.e. there dimensional), provided by an appropriate resistance application system that may be used with selected resistances at the user's lateral sides to emulate and facilitate proper integrated athletic motion training of squat related exercises.

In a preferred form, the resistance application system comprises of a balanced user synchronized resistance, transferred or provided by two essentially massless, harness emulating engageable devices, emanating from regions adjacent to the user's respective lateral sides. More particularly, these essentially massless resistance transferring or providing devices eliminate those mass related problems and limitations associated with prior art. Furthermore, a zero torque condition exists when these device emanate from regions adjacent to the user's respective lateral sides at an elevation in line with the user's foot-floor contact. This zero torque environment permits traditional squats and other similar lifts or movements to be properly performed through the user's natural center of gravity, thereby eliminating incorrect anatomical positioning, articulation and potential injury of those musculo-skeletal systems of the lower back, hips, knees and ankle regions, associated with prior squat related devices. In addition, the resistance application system is preferably point engageable along the user's squatting range, thus eliminating fear and potential injury associated with failed attempts in barbell squatting. Within this environment of thoracic engagement and resistance application, an athlete may perform safely a wide variety of squat related exercises for proper integrated athletic motion training to challenge any skill level.

Although the thorax or upper torso provides exceptional three dimensional engagement, it also yields inherent problems associated with active muscles and respective limb movements of the shoulder, axilla, upper arm, neck, waist and other involved regions. To avoid these "active" regions, the load bearing thoracic harness of the present invention is anatomically designed and generously cut to permit maximum unrestricted movement and comfort to those respective active area. More particularly, shoulder scye configurations provide appropriate clearance to those shoulder muscles acting upon and about the upper humerus region and include the pectoralis major, deltoid (anterior, middle, posterior), trapezius, infraspinatus, teres minor and major, and the latissimus dorsi.

The non-restricting shoulder scye configuration is maintained by two transversely oriented structures that connect opposing shoulder scye regions posteriorly and anteriorly. Posteriorly, a back panel spans the upper back to maintain opposing laterally opening shoulder scye concavities (adjacent to the posterior aspects of the axilla) which provide sufficient clearance to those respective muscles of the trapezius, deltoid (middle, posterior), infraspinatus, teres minor and major, and the latissimus dorsi. Anteriorly, an adjustable connector or frontal strap spans the upper chest (adjacent to the anterior aspects of the axilla) to maintain opposing laterally opening shoulder scye concavities, which provide sufficient clearance to those respectively acting muscles of the pectoralis major, deltoid (anterior, middle) and trapezius. With this specific positioning of the frontal strap and the location and configuration of the anterior shoulder scye concavities, uncomfortable and potentially harmful contact with downwardly adjacent breast tissus is avoided, thus the benefits of the present invention can be equally utilized by male or female. In addition, this non-restricting anatomically designed harness of the present invention provides superior self-maintaining, three dimensional thoracic engagement that assures natural ranges of motion to the thorax itself and to those involved active regions of the shoulder, axilla, upper arm, neck and waist. Furthermore, this unrestricted hand, arm and shoulder use permits the user to "spot" him or herself by employing a railing system or by pushing down on top of the thighs, thus facilitating greater gains by enabling self monitoring and self assistance.

These and still further objects and advantages will become apparent upon reading the following detailed description which, taken with the accompanying drawings, disclose a preferred form of the invention.

BRIEF DESCRIPTION OF THE DRAWINGS

A preferred embodiment of the present invention is illustrated in the accompanying drawings, in which.

DETAILED DESCRIPTION OF THE PREFERRED EMBODIMENT

The following disclosure of the invention is submitted in furtherance with the constitutional purpose of the Patent Laws "to promote the progress of science and useful arts" (article 1, section 8).

Figure 1:
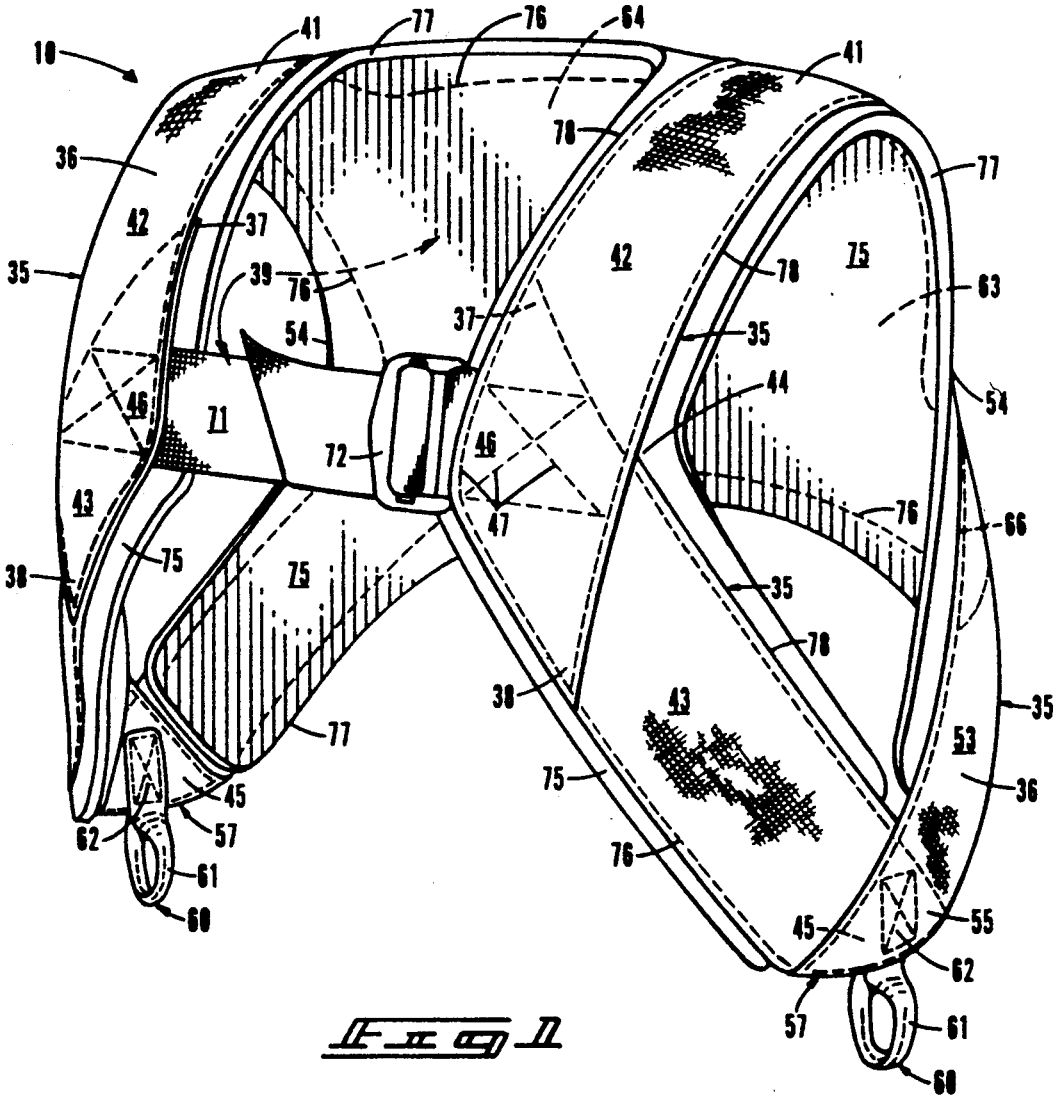
FIG. 1 is a frontal perspective view of a preferred form of the present harness.
Figure 2:
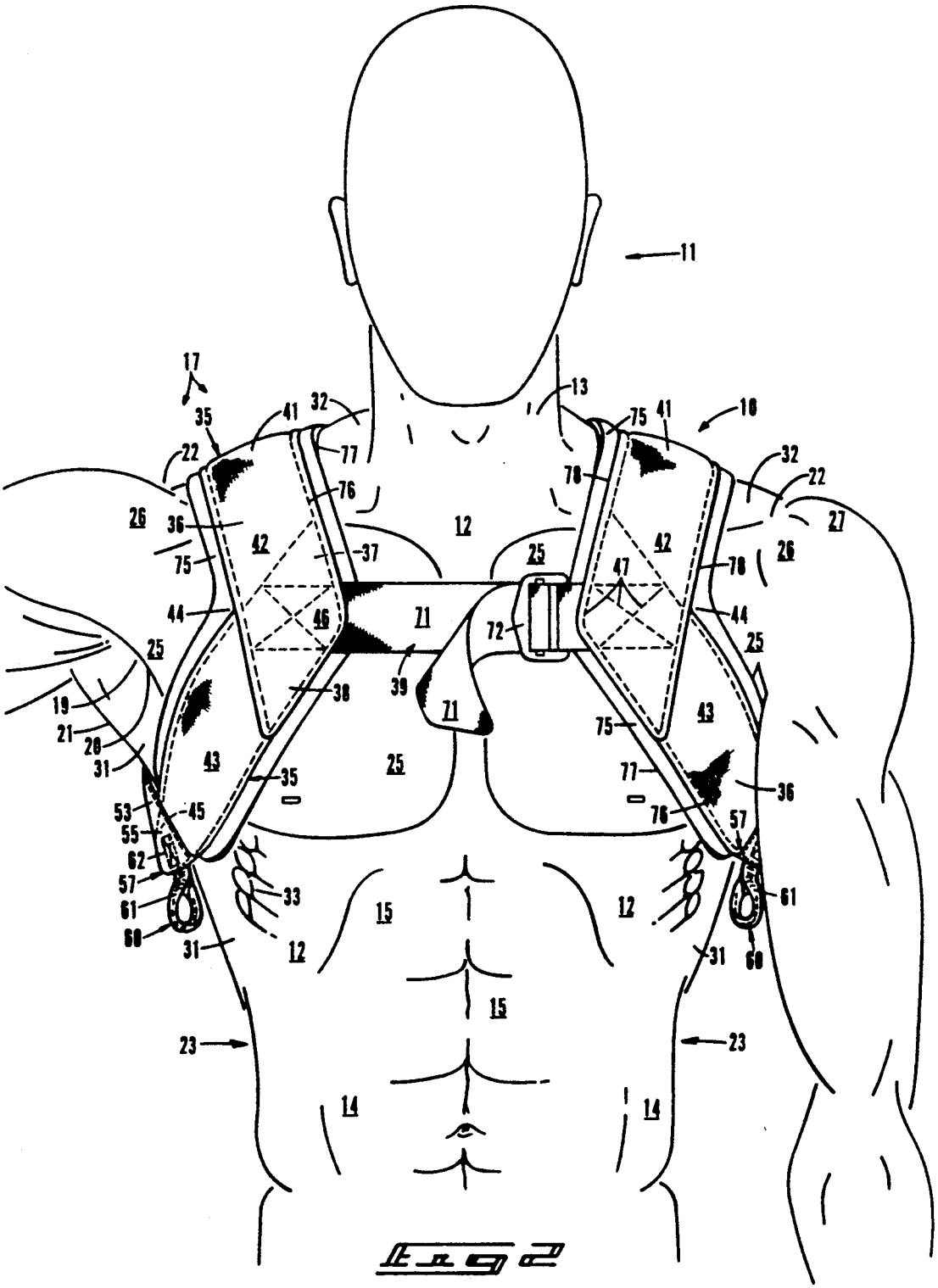
FIG. 2 is a frontal elevation view of the harness, with a user shown diagrammatically therein.
Figure 3:
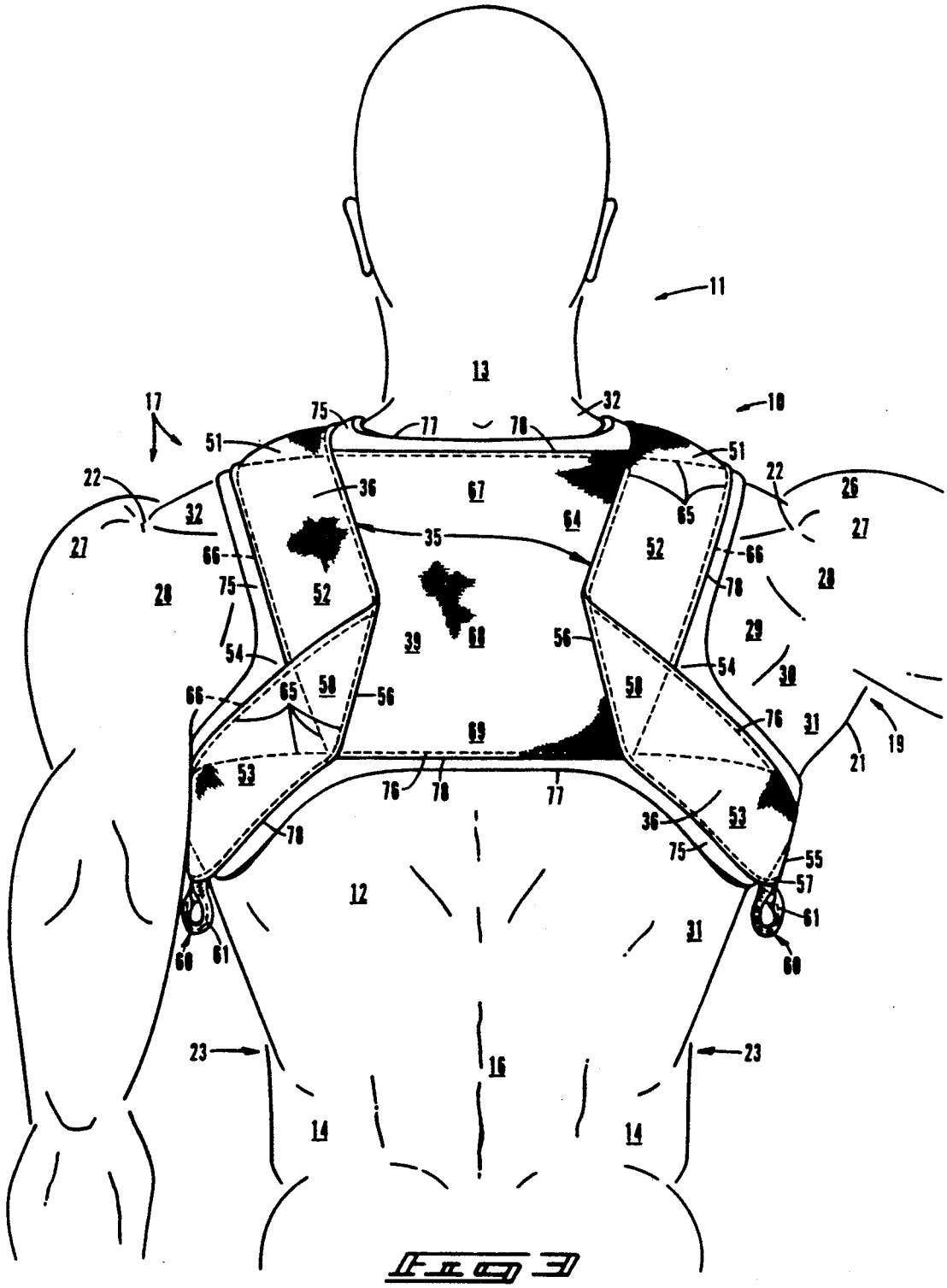
FIG. 3 is a rear view of the present preferred harness configuration and user.
Figure 4:
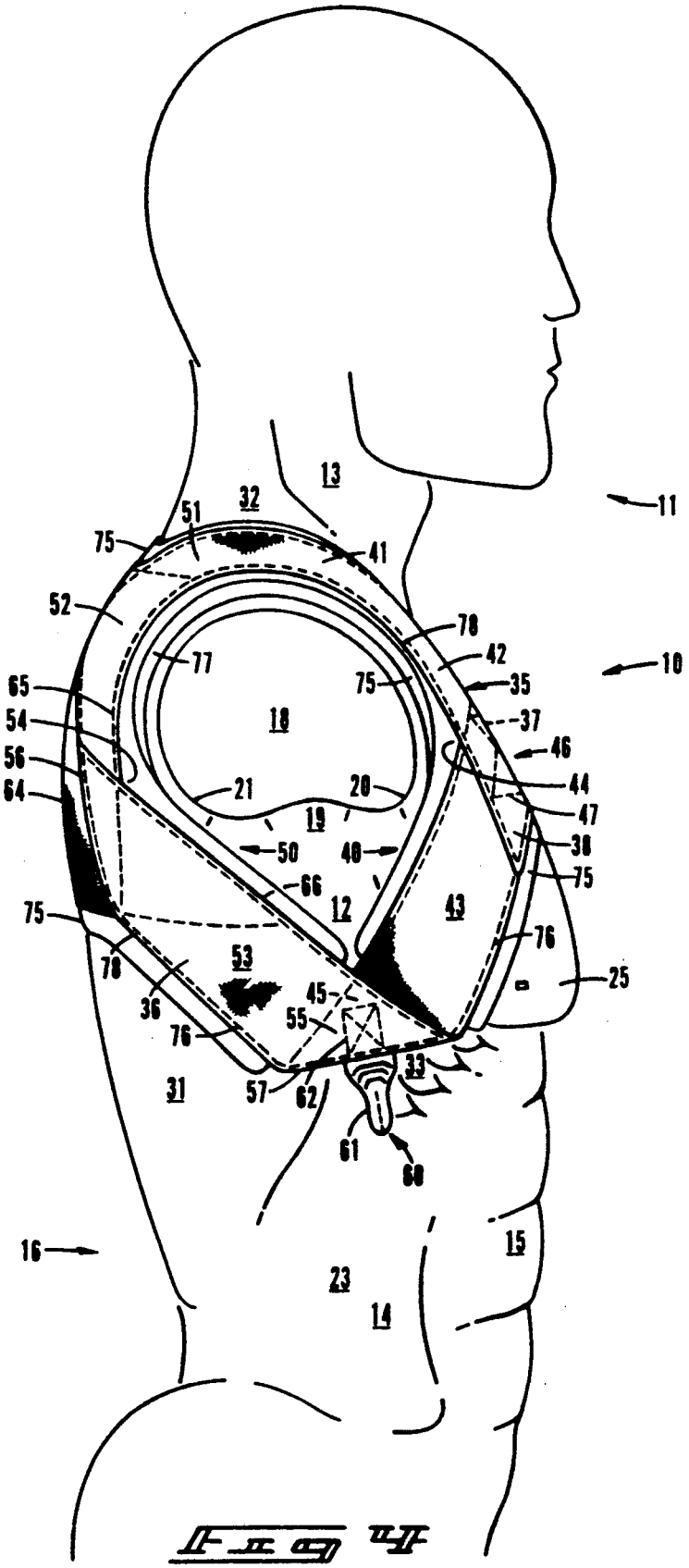
FIG. 4 is a side elevation view of the preferred harness form showing a diagrammatic sectional view taken on a sagittal plane approximately through the acromion process or point of the user's shoulder, defining the user's shoulder scye region.

A harness exemplifying preferred features of the present invention is generally identified in the drawings by the reference numeral 10. The harness 10 is shown alone in FIG. 1 and mounted to the thorax 12 of a human user 11 in FIGS. 2 through 4.

For purposes of gaining a more complete understanding of the present invention, a generalized description relating to several anatomical features of the user 11 will be generally identified. Firstly, the thorax 12 region is comprised of those musculo-skeletal systems between the neck 13 and the waist 14 and medially thereof opposing acromium processes 22, that define those furthermost lateral portions of the scapula (not shown) and represents respective shoulder points. More specifically, the skeleton of the human thorax 12 is comprised of twelve thoracic vertebrae, ribs, costal cartilage, sternum and opposing clavicles and scapulas. In addition, the inferior region 23 of the thorax 12 is defined by a transverse plane passing through the inferior most region of the twelfth thoracic vertebrae and its respective ribs.

As previously, stated, the thorax 12 demonstrates no appreciable configuration changes through its ranges of motion, and therefore provides a relatively large uniform three dimensional structure, that facilitates exceptional three dimensional engagement. Furthermore, thoracic "active" regions are of particular concern when properly designing a non-restricting load bearing harness. The shoulder scye region 18 presents the greatest activity and is defined by a shoulder 17 encircling region, medially about the acromium process 22 and axilla 19. Spanning this region are several active muscles that act from the thorax 12 to their respective insertion points upon the upper humerus (not shown). Anteriorly, the pectoralis major 25 and the anterior deltoid 26 span this area and define the anterior aspects 20 of each axilla 19. Posteriorly, the posterior deltoid 28, infraspinatus 29, teres minor and major 30, and the latissimus dorsi 31 span this region and define the posterior aspects 21 of each axilla 19. Upon the superior regions of the shoulder 17 the trapezius 32 spans from the neck 13 to the acromium process 22.

The present preferred harness 10 includes several preferred basic components. First, a pair of shoulder scyes 35 are provided to encircle the shoulder scye regions 18 medially about the acromium process 22 and the axilla 19. Resistance engaging means such as connectors 60 are provided and mounted upon each shoulder scye 35 below tha axialla 19. A back panel 64 is provided, connecting the shoulder scyes 35 across the user's upper back. A frontal strap 71 and buckle 72 extends across the upper chest area to selectively join the scyes 35. In general, the back panel 64 and front strap 71 exemplify a preferred means 39 for holding the shoulder scyes in selected positions on the user's thorax. The harness 10 also preferably includes a pad 75 on inward surfaces 63 of the shoulder scyes 35 and back panel 64 for engaging and intimately conforming to the user 11.

Referring now more particularly to the several preferred components of the novel harness, attention is first drawn to the individual shoulder scyes 35 which are advantageously comprised of individual lengths of flexible strong belts 36 such as a nylon webbing or other appropriate material, folded onto itself to form a loop configuration. Each formed loop includes an anterior section 40 and a posterior section 50.

The anterior section 40 of each loop includes an anterior trapezius portion 41 adapted to span the trapezius 32 area in an anterior direction. These anterior trapezius portions 41 lead downward in a medial anterior direction into the superior pectoralis portions 42, that continue in the same direction to opposing regions on the upper chest adjacent to the axilla's anterior aspects 20. Here, the inferior pectoralis portions 43 angle downward in a lateral posterior direction (forming opposing laterally opening anterior concavities 44) and terminate at their respective anterior axilla portions 45.

Each posterior section 50 of the shoulder scyes 35 include a posterior trapezius portion 51 adapted to span the trapezius area 32 in a posterior direction from the anterior trapezius portion 41. These posterior trapezius portions 51 lead downward in a medial posterior direction into inferior trapezius portions 52 that continue in the same direction to opposing regions on the upper back adjacent to the axilla's posterior aspects 21. Here, a latissimus portions 53 angle downward in a lateral anterior direction (forming opposing laterally opening posterior concavities 54) to their respective posterior axilla portions 55 that are further joined with their respective anterior axilla portions 45. The axilla portions 45 and 55 are adapted to be situated substantially immediately below the user's axillae 19 and preferably at an elevation adjacent to the serratus anterior muscles 33, or at or above the inferior region 23 of the thorax to avoid independent movement of the active region of the waist 14.

The belting 36 that form the shoulder scyes 35 include opposing ends 37 and 38 that may be overlapped and attached at substantially any point along the belt lengths. It is preferred that such ends 37 and 38 overlap and are stitched together at the juncture of the superior pectoralis portions 42 and the inferior pectoralis portions 43. These overlapping ends 37 and 38 are geometrically consistent so one end will cover and conceal the opposite end. Stitching 47 is provided to secure the ends together. The secured ends 37, 38 and the intersecting superior and inferior pectoralis portions 42, 43 of each scye 35 form opposing anterior concavities 44, positioned adjacent to the axillae anterior aspects 20. These anterior concavities 44 include opposed anterior apexes 46 formed at the overlapping ends 37 and 38. The anterior concavities 44 open laterally outward and are adapted to avoid those active muscles and tissues of the axillae anterior aspects 18. Posteriorly, the belting 36 of each shoulder scye 35 is folded onto itself at the junctures of the inferior trapezius portions 52 and the latissimus portions 53. These folds 56 form oposing laterally opening posterior concavities 54 with opposed posterior apexes 58, that are substantially similar to those anterior concavities 44, and are adapted to avoid those active muscles and tissues of the axillae posterior aspects 21.

At the junctures of the inferior pectoralis portions 43 and the latissimus portions 53, the belting 36 of each shoulder scye 35 is folded onto itself at the axilla portions 45 and 55. Such folds 57 determine that the positions of the axilla portions 45, 55 are situated directly below the axillae 19 when positioned on a user 11. Each of these folds 57 or axilla portions 45, 55 mount a resistance connector 60. Such connectors 60 are preferably provided in the form of flexible loops 61 attached by box stitching 62 or other attachment means to the axilla portions 45, 55 of the shoulder scyes 35. These loops 61 are intended to have sufficient strength to attach and hold significant amounts of resistance as may be supplied through an appropriate resistance application system (not shown) secured to the loops 61 at the user's opposing lateral sides.

To maintain proper anatomical shoulder scye 35 configuration, three dimensional engagement, and overall proper thoracic positioning, the means 39 for holding the shoulder scyes in selected positions incorporates two transversely mounted structures to interconnect opposing shoulder scye 35 regions posteriorly and anteriorly. Posteriorly, this structure preferably is comprised of a back panel 64, provided in the form of a strong lightweight flexible material such as a nylon webbing transversely secured to opposing posterior shoulder scye sections 50 of the trapezius portions 51, 52 and latissimus portions 53 by stitching 65 or other appropriate fastening means. In particular, lateral edges 66 of the back panel 64 are geometrically consistent to the lateral edges of those involved posterior shoulder scye sections 50. This superior design assures a large uniform distribution of engaging forces across the upper back, as opposed to a crisscrossed design of posterior shoulder scye structural sections about the upper back. Superiorly, the back panels' 64 top portion 67 is generously cut to accommodate those active regions of the neck's lower posterior portions and in addition, provides proper anatomical positioning of those shoulder scye sections 35 that span over the user's shoulders 17. The back panels' 64 central portion 68 maintains those opposing laterally opening posterior concavities 54 that are adapted to avoid those active muscles and tissue of the axillae posterior aspects 20. Inferiorly, the back panel's bottom portion 69 provides a preferred uniform force engaging support between respective latissimus portions 53 during an anterior rotation of the user's upper torso, like that experienced in squatting. Furthermore, the bottom portion 69 effectively decreases lower back torque to a safe yet appropriate level during those lower squat positions. In addition, this bottom portion 69 is cut to minimize overall bulk and harness dimension, yet provide sufficent respective surface area engagement.

Anteriorly, means 39 preferably is comprised of a front strap 71 provided in the form of a strong lightweight flexible material such a nylon webbing transversely secured by means of stitching 47 or other appropriate fastening means to opposing apex structures 46 of each anterior concavity 44. Primarily, the front strap 71 serves to maintain proper anatomical anterior shoulder scye 40 configuration, and in particular those opposing laterally opening anterior concavities 44 that are adapted to avoid those active muscles and tissues of the axillae anterior aspects 20 and respective lower anterior portion of the user's neck. The front strap 71 is also primarily utilized along with the buckle 72 to selectively adjust and secure the harness 10 to individuals of different size. Additionally, the front strap 71 and buckle 72 are so situated as to facilitate use of the present harness 10 by male or female athletes. The elevation of the strap 71 at the superior pectoral regions avoids discomfort and potential harm to downwardly adjacent breast tissues.

The remaining preferred basic component of the present invention includes a pad 75 that is cut to conform to the configuration of the scyes 35 and the back panel 64. Pad 75 is stitched 76 or otherwise secured to inward surfaces 63 of the shoulder scyes 35 and back panel 64 to prevent independent movement. Thus, the soft resilient material of the pad (preferably neoprene) will facilitate an intimate, yet comfortable thoracic engagement. Furthermore, the pad's perimeter 77 is appropriately extended about respective structural edges 78 of the shoulder scyes 35 and back panel 64 to "feather off" potentially harmful engaging forces of abrupt structural edges 78.

The should scyes 35, back panel 64, front strap 71 and pad 75 of the above described invention function collectively to provide a comfortable, yet intimate three dimensional thoracic engagement that facilitates a uniform three dimensional dispersion of forces once a resistance is offered at the lateral resistance connectors 60 below each axillae 19. This intimate engagement is firmly maintained throughout any squat related movement the user chooses to perform. There is therefore no significant independent movement permitted between the harness 10 and engaged user 11, even during a thoracic rotation occurring in the user's transverse plane. Furthermore, the superior three dimensional thoracic engagement of the harness described above and shown in the drawings is self-maintaining, non-restricting, user synchronized and balanced at the two lateral points of resistance connection. In particular, the harness 10 configuration described above is specifically adapted to apply a squat related integration of sagittal, frontal and transverse plane resistance that opposes user 11 emulated movements for the proper integrated athletic motion training of squat related fundamental athletic movements.

The present invention is advantageously used with a preferred resistance application system (not shown) that attaches to the lateral resistance connectors 60. As mentioned above, the preferred resistance application system is comprised of a balanced user synchronized resistance, transferred or provided by two essentially massless, harness emulating engageable devices, emanating from regions adjacent to the user's respective lateral sides, at an elevation in line with the user's foot-floor contact and selectively point engageable along the the user's squatting range. Within this environment of superior thoracic engagement provided by the present invention and the preferred resistance application system, those problems and limitations of previous art are eliminated, thus permitting an athlete to properly perform integrated athletic motion training of a wide variety of squat related fundamental athletic movements to challenge any skill level.

OPERATION

In operation, the harness 10 of the present invention is fitted to the user 11 in a manner quite similar to the procedures used for putting on a vest. The arms are sucessively directed through the shoulder scyes 35. This is preferably done with the front strap 71 disconnected at the buckle 72. Once both arms are through the appropriate scye 35 and the back panel 64 and shoulder scyes 35 are situated comfortably, the user may connect the front strap 71 to the buckle 72 and adjust the strap length through the buckle 72 to a point where the shoulder scyes 35 are held firmly yet comfortably. The harness 10 is now ready for use.

An appropriate resistance application system may be applied by connection to the resistance connectors 60. The specific position of the resistance connectors 60 directly below the axillae 19 assures that the user is being offered resistance that will, as indicated above, automatically facilitate exercise without significant potential for injury and with the capability of performing exercises about the user's 11 three dimensional space. During the exercise routine, the harness functions to spread a three dimensional resistance uniformly about those engaged thoracic surfaces to oppose respective thoracic movements. Lastly, the harness 10 of the present described invention is anatomically designed to provide superior thoracic engagement and maximum unrestricted movement of those respective active regions of the shoulder scye 18, lower neck 13, and those inferior thoracic regions 23 of the waist 14, abdomen 15 and lower back 16.

Once the exercise routine has been completed, the resistance application system may be disconnected from the resistance connectors 60, and the harness 10 may be removed simply by removing the front strap 71 from the buckle and by pulling the arms from the shoulder scyes 35.

In compliance with the statute, the invention has been described in language more or less specific as to structural features. It is to be understood, however, that the invention is not limited to the specific features shown, since the means and construction herein disclosed comprise of a preferred form of putting the invention into effect. The invention is, therefore, claimed in any of its forms or modifications within the proper scope of the appended claims appropriately interpreted in accordance with the doctrine of equivalents.

I claim:

1. A thoracic exercise harness for distributing forces about a person's thoracic region comprising:

a pair of shoulder scyes for engaging and encircling a person's thoracic shoulder regions, each shoulder scye including:

a posterior portion;

an anterior portion;

said posterior and anterior portions joined at the apex and nadir thereof forming an integral shoulder scye; and, an axilla portion integral with said posterior and anterior portions at the nadir thereof, the anterior and posterior portion extending a substantially equidistant length from said apex to said axilla portion, wherein the axilla portion is positioned directly below the axillae;

said posterior portions of said shoulder scyes having upper trapezius portions downwardly converging towards one another and lower latissimus portions downwardly diverging away from one another, said converging upper trapezius portions and diverging lower latissimus portions avoiding the person's shoulders, axillae, neck and waist;

a posterior support portion joining said posterior portions for maintaining the positioning of said posterior portions;

said anterior portions of said shoulders scyes having superior pectoral portions downwardly converging towards one another and inferior pectoral portions downwardly diverging away from one another, said converging superior pectoral portions and diverging inferior pectoral portions avoiding the person's shoulders, axillae, neck, waist and abdomen;

an anterior support portion joining said anterior portions for maintaining the positioning of said anterior portions; and a resistance engaging means mounted on each said axialla portion.

2. The thoracic exercise harness of claim 1 further comprising a pad on the inner surface of said shoulder scyes and said posterior support portion.

3. The thoracic exercise harness of claim 1 wherein said anterior support portion includes an adjustable joining means for joining said anterior portions.

4. The thoracic exercise harness of claim 3 wherein said adjustable joining means is an adjustable strap.

5. The thoracic exercise harness of claim 1 wherein said posterior support portion includes a flexible back panel joining said posterior portions for uniform thoracic dispersion of posterior forces.

6. The thoracic exercise harness of claim 1 wherein said resistance engaging means are loops.

* * * * *